US010890170B2

(12) United States Patent
Rogers

(10) Patent No.: US 10,890,170 B2
(45) Date of Patent: Jan. 12, 2021

(54) REPLACEMENT TUBE FOR A CELLULAR SUCTION STABILIZING MANIFOLD

(71) Applicant: Performance Pulsation Control, Inc., Richardson, TX (US)

(72) Inventor: John Thomas Rogers, Garland, TX (US)

(73) Assignee: Performance Pulsation Control, Inc., Richardson, TX (US)

( * ) Notice: Subject to any disclaimer, the term of this patent is extended or adjusted under 35 U.S.C. 154(b) by 1 day.

(21) Appl. No.: 16/374,679

(22) Filed: Apr. 3, 2019

(65) Prior Publication Data

US 2019/0309741 A1 Oct. 10, 2019

Related U.S. Application Data

(60) Provisional application No. 62/652,792, filed on Apr. 4, 2018.

(51) Int. Cl.
*F04B 39/00* (2006.01)
*F04B 11/00* (2006.01)

(52) U.S. Cl.
CPC ..... *F04B 39/005* (2013.01); *F04B 11/00* (2013.01); *F05B 2210/13* (2013.01); *F05B 2250/501* (2013.01); *F05B 2280/6012* (2013.01); *F05B 2280/702* (2013.01)

(58) Field of Classification Search
CPC . F16L 55/04; F04B 39/005; F05B 2280/6012; F05B 2280/702
USPC ..... 138/26, 30; 417/568, 539, 540
See application file for complete search history.

(56) References Cited

U.S. PATENT DOCUMENTS 2,078,754 A * 4/1937 Day ..... F01N 1/02 181/240
3,799,196 A * 3/1974 Scheitlin ..... F01N 13/102 137/561 A
4,049,387 A * 9/1977 Futamura ..... F01N 3/26 422/168
7,621,728 B2 * 11/2009 Miller ..... F04B 53/16 417/454
9,441,776 B2 * 9/2016 Byrne ..... F04B 11/0008
2005/0276708 A1 12/2005 Miller
2014/0130887 A1 5/2014 Byrne et al.
2014/0251486 A1 9/2014 Gunsing
2015/0300332 A1 10/2015 Kotapish et al.
2016/0369926 A1 12/2016 Shuck

OTHER PUBLICATIONS

Notification of Transmittal of the International Search Report and the Written Opinion of the International Searching Authority, or the Declaration dated Jun. 20, 2019 in connection with International Patent Application No. PCT/US2019/025883, 8 pages.

* cited by examiner

*Primary Examiner* — Patrick F Brinson

(57) ABSTRACT

A replacement tube for a manifold is provided. The replacement tube includes a closed cell foam and a reinforcement strip. The closed cell foam is formed in a cylindrical tube and flexible to absorb pressure pulsations in a chamber of a suction manifold or in another device. The reinforcement strip is fixed along a length of the closed cell foam to support the closed cell foam from flexing and collapsing along the length of the closed cell foam.

20 Claims, 9 Drawing Sheets

REPLACEMENT TUBE FOR A CELLULAR SUCTION STABILIZING MANIFOLD

PRIORITY CLAIM

This application claims priority to U.S. Provisional Patent Application No. 62/652,792 filed Apr. 4, 2018 and entitled REPLACEMENT TUBE FOR A CELLULAR SUCTION STABILIZING MANIFOLD. The content of the above-identified patent documents is incorporated herein by reference.

TECHNICAL FIELD

The present application relates generally to the operation of a pump inlet manifold and, more specifically, to providing a replacement tube for a cellular suction stabilizing manifold.

BACKGROUND

A manifold with a liner or tube is used with a reciprocating pump to evenly distributed particulates contained in the pumped fluid to and reduce pulsation energy into the reciprocating pump. The tube flexes to reduce the pulsation levels experienced by the fluid with particulates or particulate laden fluid in the pumped fluid from the pumping motion. Because the tube is flexible, some particulates are forced into contact with, around and under the tube. The particulates impacting the tube and flowing around the tube cause the tube to linearly compress. The particulates under the tube cause the tube to be squeezed and both axially and linearly compressed, making it hard to be removed and hard to replaced.

SUMMARY

In one aspect thereof, a replacement tube for a cellular suction stabilizing manifold is provided. The replacement tube includes a closed cell foam and a reinforcement device. The closed cell foam is formed in a cylindrical tube and flexible to absorb pressure pulsations in a chamber of a suction manifold or in another device. The reinforcement device is fixed along a length of the closed cell foam to support the closed cell foam from flexing and collapsing along the length of the closed cell foam.

In another aspect thereof, a cellular stabilizing manifold is provided. The cellular suction stabilizing manifold includes a suction manifold and a replacement tube. The replacement tube includes a closed cell foam and a reinforcement device. The closed cell foam is formed in a cylindrical tube and flexible to absorb pressure pulsations in a chamber of a suction manifold or in another device. The reinforcement device is fixed along a length of the closed cell foam to support the closed cell foam from flexing and collapsing along the length of the closed cell foam.

In yet another aspect thereof, a method for forming a replacement tube is provided. The method includes forming a closed cell foam in a cylindrical tube that is flexible to absorb pressure pulsations in a chamber of a cellular suction stabilizing manifold or in another device; and fixing a reinforcement device along a length of the closed cell foam to support the closed cell foam from flexing and collapsing along the length of the closed cell foam.

The reinforcement device(s) embodiments may be multiple strips, external strips, internal and or external perforated sheet metal fixed or embedded in and along a length of the closed cell foam and configured to support the closed cell foam from collapsing along the length of the closed cell foam. The closed cell foam is structured in a manner that an external axial force is created against an inner wall of the cellular suction stabilizing manifold. The replacement tube further comprises a plurality of reinforcement strips, each reinforcement strip embedded in and along a length of the closed cell foam. The reinforcement strip can be made of perforated sheet metal. A first end of the closed cell foam is tapered in a manner that an inner diameter length is shorter than an outer diameter length. A flat metal disc can be added to each end of the closed cell foam.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; and the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged suction stabilizing device that can be used to control or partially control suction pulsation energy amplitudes.

The suction pressure puts external, internal and axial pressure on the tube causing it to generally compress in these directions. This reduces the size of the tube as well as the interface force between the OD of the tube and ID of the manifold. This in part creates space for the particulates in the fluid to flow and wedge between the OD of the tube and the ID of the manifold. Also, the particulates in the fluid not only put axial compression forces on the tube, but also a linear compression force along the length of the tube. The compression of the tube by suction pressure and the linear compression force causes a gap to form between the tube and the inlet of the manifold. The liner forces also cause the length of the tube to shorten and to be forced and wedged into the opposite end of the manifold. Particulates in the fluid will over time get gradually forced into the gap and continues to get pushed between the outer side of the tube and the inside of manifold. These particulates act as a wedge and increases the difficulty for removal of the tube. The linear compression of the tube to the opposite end also makes the tube removal more difficult.

Figure 1A:
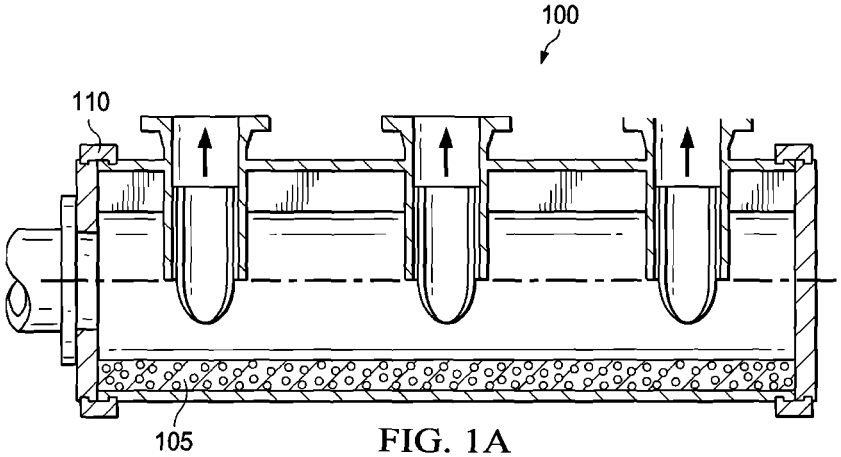
FIGS. 1A and 1B illustrate an exemplary cellular suction stabilizing manifold according to various embodiments of the present disclosure.
Figure 1B:
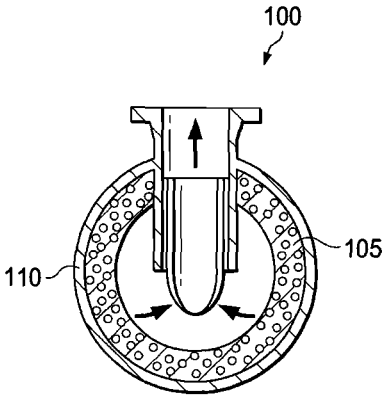

FIGS. 1A and 1B illustrate an exemplary cellular suction stabilizing manifold 100 according to various embodiments of the present disclosure. FIG. 1A illustrates a cross section along the length of the cellular suction stabilizing manifold 100 according to various embodiments of the present disclosure. FIG. 1B illustrate a cross section along the width of the cellular suction stabilizing manifold 100 according to various embodiments of the present disclosure. The embodiment of the cellular suction stabilizing manifold 100 illustrated in FIGS. 1A and 1B are for illustration only. FIGS. 1A and 1B do not limit the scope of this disclosure to any particular implementation of a stabilizing manifold or other suction stabilizing and pulsation control device.

The tube 105 is inserted into the suction manifold 110 to reduce wear on the interior of the suction manifold 110 and to reduce the complexity of manufacturing the suction manifold 110. The combination of the suction manifold 110 and the tube 105 provide a virtually constant output of particulates in a fluid through a plurality of outputs. The tube 105 is a replaceable part inserted through an opening created by a removable inlet cover that has an opening to allow flow to enter the manifold as well as a removable cover on the blindside or non-flow side of the manifold. As the tube 105 is worn down from the particulates and fluid disbursement, or as the tube loses its contained cellular gas, or as the tube collapses causing the tube to further lose its responsiveness capabilities, the tube 105 can be replaced.

With a suction manifold 110 with substantially smooth interior without any internal protrusions, a tube 105 can be manufacture with a similarly substantial smooth exterior without any external protrusions. An exception to the absence of protrusions on the suction manifold 110 or the tube 105 would be protrusions for purposes of alignment of the outputs or protrusions around the inputs and outputs. For example, an internal protrusion could be manufactured in the interior of the suction manifold 110 to match with groove manufactured in the exterior of the tube 105. Other exceptions to the absence of protrusions could include small lips or fittings around the openings between the suction manifold 110 and the tube 105. The suction manifold 110 is discussed in greater detail with the discussion corresponding to FIGS. 2A and 2B.

The tube 105 is a closed cell foam that includes a reinforcement strip or a plurality of reinforcement strips, which will be described in greater details corresponding to FIGS. 3A-3E. The tube 105 flexes to absorb pressure pulsation in a chamber of the cellular suction stabilizing manifold. The tube 105 is structured as a cylindrical tube to removably couple to the inside of the suction manifold 110. The tube 105 can include a cellular or non-cellular skin or outer covering.

Figure 2A:
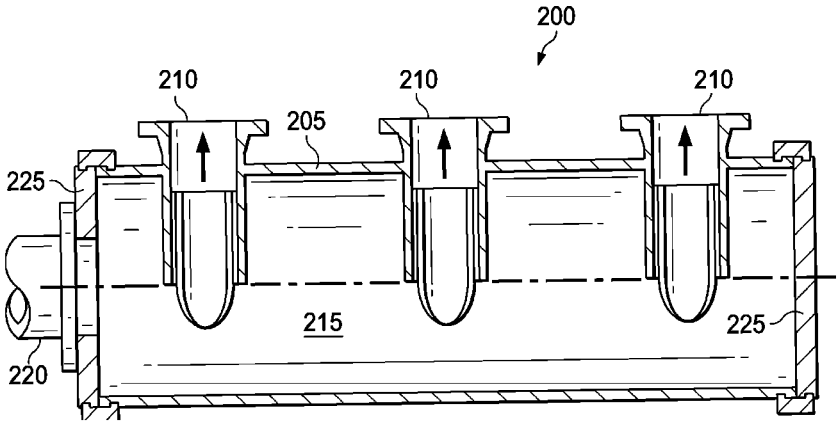
FIGS. 2A and 2B illustrate an exemplary suction manifold according to various embodiments of the present disclosure.
Figure 2B:
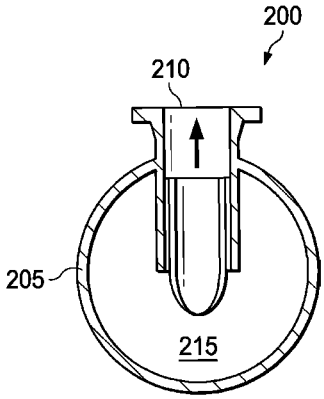

FIGS. 2A and 2B illustrate an exemplary suction manifold 200 according to various embodiments of the present disclosure. FIG. 2A illustrates a cross section along the length of the suction manifold 200 according to various embodiments of the present disclosure. FIG. 2B illustrate a cross section along the width of the suction manifold 200 according to various embodiments of the present disclosure. The embodiment of the suction manifold 200 illustrated in FIGS. 2A and 2B are for illustration only. FIGS. 2A and 2B do not limit the scope of this disclosure to any particular implementation of a suction manifold.

The suction manifold 110 includes a cylinder wall 205, a plurality of outlets 210, a chamber 215, an inlet 220, and an end cap 225. The suction manifold 110 evenly distributes fluid with particulates or particulate laden fluid to each of the plurality of outlets 210. The suction manifold 110 is mounted on a reciprocating pump in a manner that each of the plurality of outlets 210 are in fluid communication with the reciprocating pump.

The cylinder wall 205 forms the outside structure of the suction manifold 110. The cylinder wall 205 encloses and defines the chamber 215 along with the inlet 220 and the end cap 225. The cylinder wall 205 provides the support for the tube 105 when flexing.

The number of outlets 210 matches the amount of inlets to the reciprocating pump. The location of the outlets 210 matches corresponding location of the inlets to the reciprocating pump. The plurality of outlets 210 receives an even amount of fluid with particulates or particulate laden fluid from the chamber 215. The cylindrical tube 105 includes outlet or outlets that align with the plurality of outlets 210 when being inserted in the suction manifold 110.

The chamber 215 is formed by the cylinder wall 205, the inside of the tube 105 when inserted, the inlet 220, and the end cap 225. The fluid with particulates or particulate laden fluid is concentrated in the chamber 215 in a manner that the amount of fluid with particulates or particulate laden fluid is evenly distributed to the reciprocating pump.

The inlet 220 is connected to a supply pump for supplying fluid with particulates or particulate laden fluid to the chamber 215. The inlet 220 defines part of the chamber 215. The tube 105 is linearly supported to work against the linear compression that would normally form a gap between the inlet 220 and the tube 105.

The end cap 225 seals the end of the cylinder wall 205. The end cap 225 defines the final portion of the chamber 215. The end cap 225 is mounted at the cylinder wall 205 opposite to the inlet 220. In certain embodiments, the end cap 225 will be a blind with holes or slots that correspond to the shape of the reinforcement strips used in the foam tube 105. The holes or slots will provide extra strength to the reinforcement strips and the position the foam tube in alignment with the suction manifold 200.

Figure 3A:
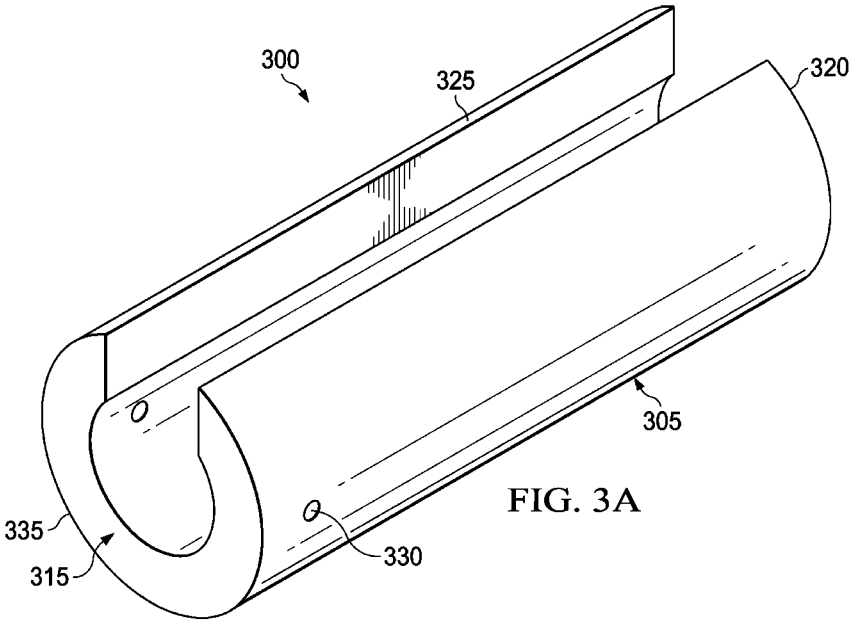
FIGS. 3A, 3B, 3C, 3D and 3E illustrate an exemplary replacement tube for a cellular suction stabilizing manifold according to various embodiments of the present disclosure.
Figure 3B:
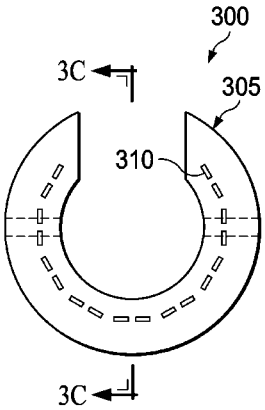
Figure 3E:
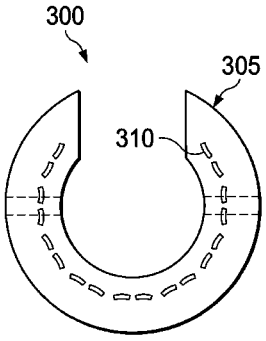
Figure 3C:
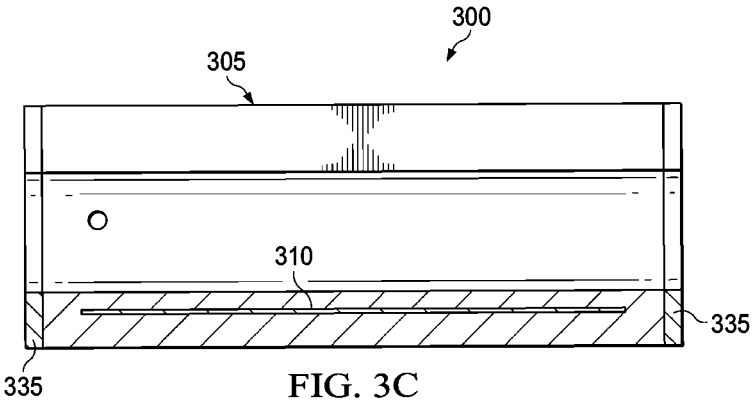
Figure 3D:
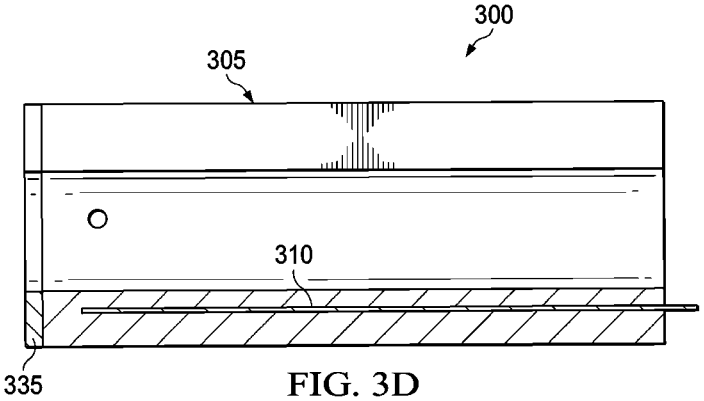

FIGS. 3A, 3B, 3C, 3D and 3E illustrate an exemplary replacement tube 300 for a cellular suction stabilizing manifold 100 according to various embodiments of the present disclosure. FIG. 3A illustrates a solid view of the replacement tube 300 according to the various embodiments of the present disclosure. FIGS. 3B and 3E illustrate alternative cross sections across the width of the replacement tube 300 according to the various embodiments of the present disclosure. FIGS. 3C and 3D illustrate alternative cross sections across the length of the replacement tube 300 according to the various embodiments of the present disclosure. The embodiment of the replacement tube 300 illustrated in FIGS. 3A, 3B, 3C, 3D and 3E are for illustration only. FIGS. 3A, 3B, 3C, 3D and 3E do not limit the scope of this disclosure to any particular implementation of a replacement tube.

The replacement tube 300 is an example of a modification for the original tube and the features of replacement tube 300 can be implemented in replacement tube 105. The replacement tube 300 includes a closed cell foam tube 305, and a reinforcement strip 310. In some embodiments, a flat metal disc 335 (or other shaped structure) located at the end or ends of the tube is included.

The closed cell foam tube 305 includes a front end 315, a back end 320, an open portion 325, and a hole 330. The closed cell foam tube 305 flexes to reduce pulsations caused by the reciprocating pump.

The reinforcement strip 310 is placed or fixed in the interior or on the exterior of the closed cell foam tube 305. The reinforcement strip 310 can be on the inner diameter or outer diameter and runs the length of the closed cell foam tube 305. The reinforcement strip 310 can be solid or perforated and also can be a perforated flat sheet shaped to fit inside or on one or more of the surfaces of closed cell foam tube 305.

In certain embodiments, a plurality of reinforcement strips 310 are used. The plurality of reinforcement strips 310 are distributed throughout the closed cell foam tube 305. The spacing of the reinforcement strips 310 could be positioned in an annular ring at the same depth or at a variable depth. For example, the reinforcement strips 310 next to the open portion of the tube could be closer to the inner surface of the closed cell foam tube 305.

In certain embodiments, the reinforcement strip 310 is formed in a 'c' shape to fill an entire annular ring of the closed cell foam tube 305. In an alternative embodiment, a plurality of 'c' shaped strips could be positioned along the length of one or more linear reinforcement strips and may be attached to the linear strips. When 'c' strips are use, one 'c' strip can be used at each end of the closed cell foam tube 305.

The flat metal disc or "head" 335 (or other shaped structure) can be installed on each end of the replacement tube, or on only one end (e.g., next to the end cap 225 for the inlet 220). The flat metal disc 335 protects the end of the closed cell foam tube 305.

Figure 4A:
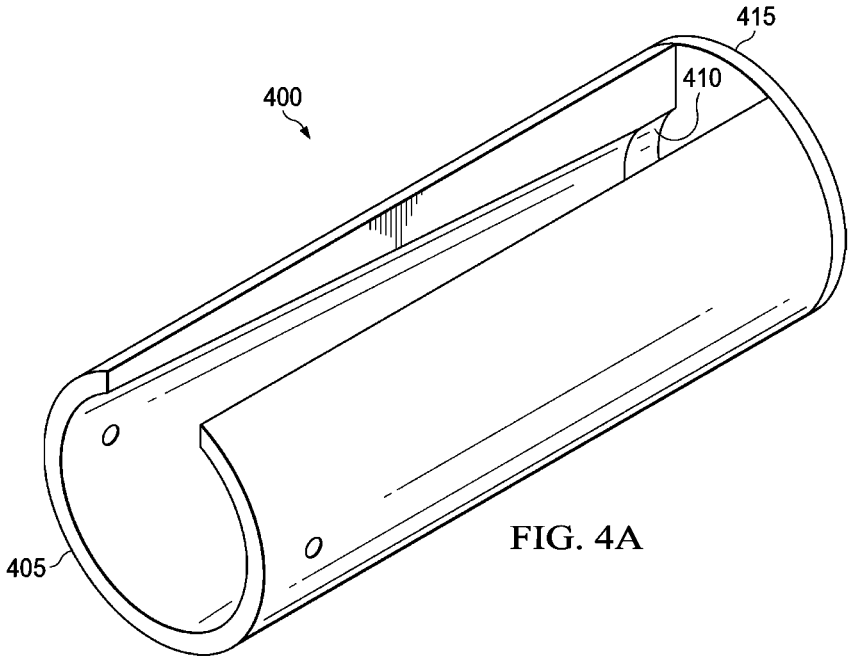
FIGS. 4A, 4B, and 4C illustrate an exemplary replacement tube with a variable inner diameter according to various embodiments of the present disclosure.
Figure 4B:
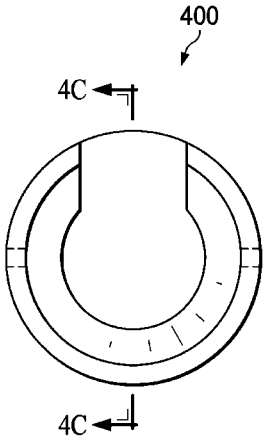
Figure 4C:
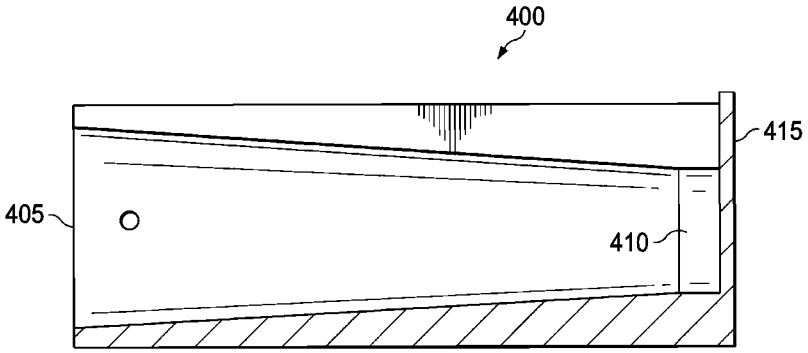

FIGS. 4A, 4B, and 4C illustrate an exemplary replacement tube 400 with a variable inner diameter according to various embodiments of the present disclosure. FIG. 4A illustrate a solid view of the replacement tube 400 according to the various embodiments of the present disclosure. FIG. 4B illustrates a cross section across the width of the replacement tube 400 according to the various embodiments of the present disclosure. FIG. 4C illustrates a cross section across the length of the replacement tube 400 according to the various embodiments of the present disclosure. The embodiment of the replacement tube 400 illustrated in FIGS. 4A, 4B, and 4C are for illustration only. FIGS. 4A, 4B, and 4C do not limit the scope of this disclosure to any particular implementation of a replacement tube.

The replacement tube 400 is an example of a modification for the original tube and the features of replacement tube 400 can be implemented in replacement tube 105. Replacement tube 400 and replacement tube 300 are not exclusive and the features of reinforcement tube 300 can be interchanged with the features in the replacement tube 400. The variable change in inner diameter increases the consistency of the fluid with particulates or particulate laden fluid flow. As fluid with particulates or particulate laden fluid flow is removed at the first outlet, the pressure and velocity normally decrease, changing the inner diameter of the chamber by changing the inner diameter of the tube allows for a near constant pressure and velocity across the length of the chamber.

The replacement tube 400 includes a first inner diameter 405 and a second inner diameter 410. The inner diameter of the replacement tube is variable across the length. The change from the first inner diameter 405 to the second inner diameter 410 can be stepped, constant change, or variable change. For instance, the change in inner diameter can by less towards the first inner diameter 405 than the change in inner diameter by the second inner diameter 410. The change of the inner diameter can be concentric or eccentric. The change of the diameter from the first inner diameter 405 can also begin a distance from the opening of the replacement tube 400 or change between the outlets.

The replacement tube 400 can also include a solid cellular rubber 415 at a blind end. The solid cellular rubber 415 provides extra stability for the replacement tube 400, extra gas volume that increase pulsation control performance, may assist in directing the fluid with or without particulates into the last outlet and on into the last pump cylinder, and also removes a potential opening for the material to be force between the replacement tube 400 and the suction manifold. The solid cellular rubber 415 can be an additional part added to the end of a replacement tube 400 or integrally formed to the end of a replacement tube 400.

Figure 5A:
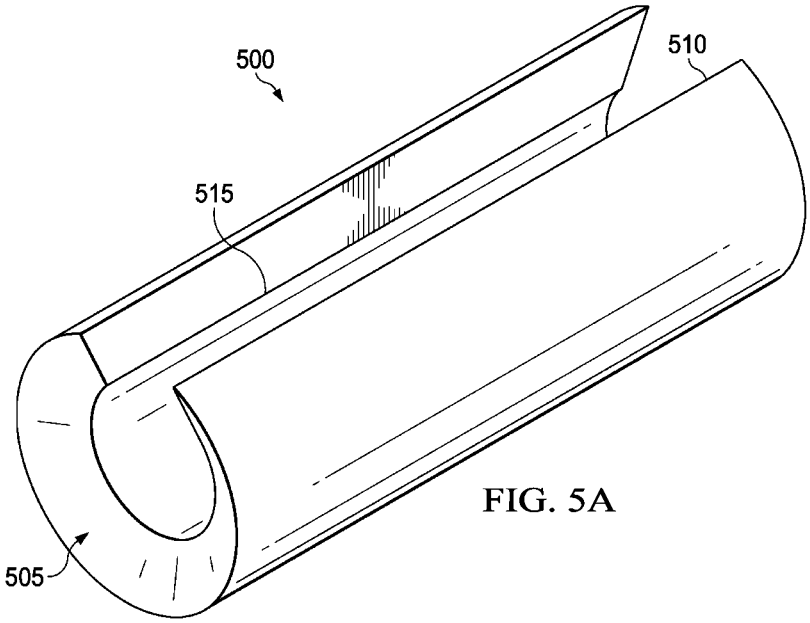
FIGS. 5A, 5B, and 5C illustrate an exemplary replacement tube with a tapered ends according to various embodiments of the present disclosure.
Figure 5B:
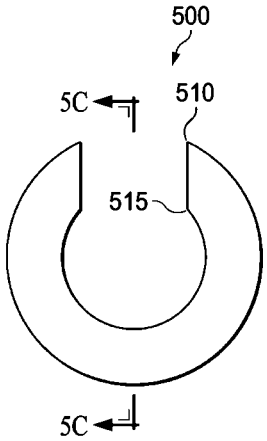
Figure 5C:
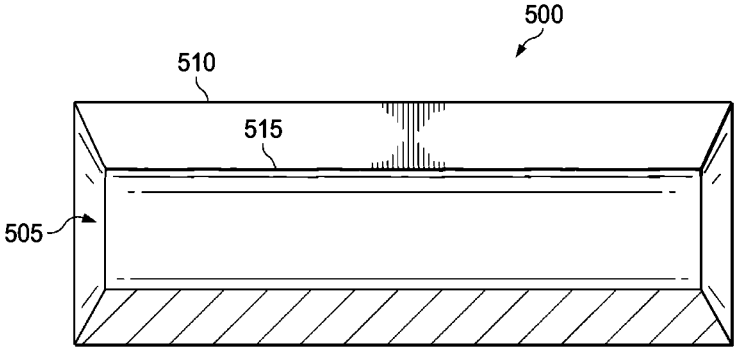

FIGS. 5A, 5B, and 5C illustrate an exemplary replacement tube 500 with tapered ends according to various embodiments of the present disclosure. FIG. 5A illustrate a solid view of the replacement tube 500 according to the various embodiments of the present disclosure. FIG. 5B illustrates a cross section across the width of the replacement tube 500 according to the various embodiments of the present disclosure. FIG. 5C illustrates a cross section across the length of the replacement tube 500 according to the various embodiments of the present disclosure. The embodiment of the replacement tube 500 illustrated in FIGS. 5A, 5B, and 5C are for illustration only. FIGS. 5A, 5B, and 5C do not limit the scope of this disclosure to any particular implementation of a replacement tube.

The replacement tube 500 is an example of a modification for the ends of the replacement tube 105 and the features of replacement tube 500 can be implemented in replacement tube 105. Replacement tube 500 and replacement tube 200 are not exclusive and the taper 505 can be implemented in the replacement tube 200.

The taper 505 of the replacement tube 500 includes an inside length 515 and an outside length 510 along the length of the replacement tube. The inside length 515 is the distance of the inner surface of the replacement tube 500 from the opening to the opposite side. The outside length 510 is the distance of the outer surface of the replacement tube 500 from the opening to the opposite side. The inside length 515 can be shorter than the outside length 510 of the replacement tube. The flat metal disc 335 can be formed to fit on the taper 505. The flat metal disc can be manufactured using a metal, such as steel.

Figure 6:
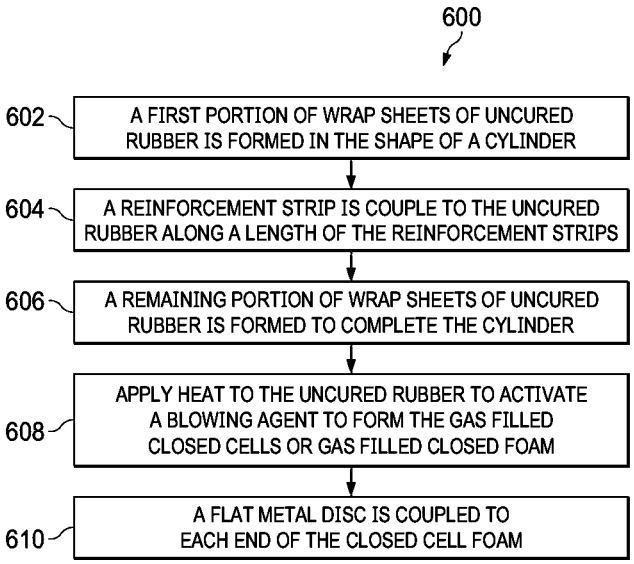
FIG. 6 illustrates a flowchart of manufacturing a replacement tube for a cellular suction stabilizing manifold according to various embodiments of the present disclosure.

FIG. 6 illustrates a flowchart of a manufacturing a replacement tube for a cellular suction stabilizing manifold according to various embodiments of the present disclosure. For example, the process 600 of FIG. 6 may be performed to manufacture a replacement tube 105 in FIGS. 1A and 1B, a replacement tube 300 illustrated in FIGS. 3A-3C, a replacement tube 400 in FIGS. 4A-4C, and a replacement tube 500 in FIGS. 5A-5C.

In operation 602, a first portion of wrap sheets of uncured rubber is formed in the shape of a cylinder. The inside diameter can be formed first to create the replacement tube from the inside out. The wrap sheets of uncured rubber can be placed on a mandrel to create the cylindrical tube.

In operation 604, a reinforcement strip is coupled to the uncured rubber along a length of the replacement tube. Multiple reinforcement strips could be coupled to the uncured rubber at a same thickness of wraps sheets or variable thicknesses of wrap sheets. As the cylindrical replacement tube is created, reinforcement strips or sheets are introduced to the manufacturing process. In the case when sheets are used, the sheets can be perforated in a manner that the uncured rubber perforates through the sheets during bonding.

In operation 606, a remaining portion of the wrap sheets of uncured rubber is formed to complete the cylinder shape. The final shape of the closed cell foam is a hollow cylinder. Either one of both ends are open to expose the hollow center. The end or ends that are open can also include a taper with the inside length is shorter than the outside length of the closed cell foam.

In operation 608, heat is applied to the uncured rubber to activate a blowing agent to form the gas filled closed cells or the gas filled closed foam. In operation 610, a flat metal disc is coupled to each end of the closed cell foam. The flat metal disc is sized to cover each end of the closed cell foam including any taper.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. A replacement tube, comprising:

a closed cell foam formed in a cylindrical tube and flexible to absorb pressure pulsations in a chamber of a suction manifold or in another device; and a reinforcement device fixed along a length of the closed cell foam and extending at least a majority of the length of the closed cell foam to support the closed cell foam from flexing and collapsing along the length of the closed cell foam, wherein the reinforcement device comprises a perforated C-shaped sheet embedded in the closed cell foam and extending circumferentially more than halfway around a central axis of the closed cell foam.

2. The replacement tube of claim 1, further comprising:

a flat metal disc is added to each end of the closed cell foam.

3. The replacement tube of claim 1, wherein the reinforcement device extends past each end of the closed cell foam.

4. The replacement tube of claim 1, wherein a first end of the closed cell foam is tapered in a manner that an inner diameter length is shorter than an outer diameter length.

5. The replacement tube of claim 1, wherein the closed cell foam is structured in a manner that an external axial force is created against an inner wall of a suction manifold.

6. The replacement tube of claim 1, wherein the replacement tube further comprises a plurality of reinforcement strips, each reinforcement strip embedded in and along a length of the closed cell foam.

7. The replacement tube of claim 1, wherein an inside diameter of the closed cell foam is wider at a front end than an inside diameter at a back end of the closed cell foam.

8. A cellular suction stabilizing manifold, comprising:

a suction manifold; and a replacement tube, the replacement tube including:

a closed cell foam formed in a cylindrical tube and flexible to absorb pressure pulsation in a chamber of the suction manifold, and removably coupled to the inside of the suction manifold; and a reinforcement device fixed along a length of the closed cell foam and extending at least a majority of the length of the closed cell foam to support the closed cell foam from flexing and collapsing along the length of the closed cell foam, wherein the reinforcement device comprises a perforated C-shaped sheet embedded in the closed cell foam and extending circumferentially more than halfway around a central axis of the closed cell foam.

9. The cellular suction stabilizing manifold of claim 8, the replacement tube further comprising:

a flat metal disc is added to each end of the closed cell foam.

10. The cellular suction stabilizing manifold of claim 8, wherein the reinforcement device extends past each end of the closed cell foam.

11. The cellular suction stabilizing manifold of claim 8, wherein a first end of the closed cell foam is tapered in a manner that an inner diameter length is shorter than an outer diameter length.

12. The cellular suction stabilizing manifold of claim 8, wherein the closed cell foam is structured in a manner that an external axial force is created against an inner wall of the suction manifold.

13. The cellular suction stabilizing manifold of claim 8, wherein the replacement tube further comprises a plurality of reinforcement strips, each reinforcement strip embedded in and along a length of the closed cell foam.

14. The cellular suction stabilizing manifold of claim 8, wherein an inside diameter of the closed cell foam is wider at a front end than an inside diameter at a back end of the closed cell foam.

15. A method for forming a replacement tube, comprising:

forming a closed cell foam in a cylindrical tube that is flexible to absorb pressure pulsations in a chamber of a cellular suction stabilizing manifold or in another device; and fixing a reinforcement device along a length of the closed cell foam and extending at least a majority of the length of the closed cell foam to support the closed cell foam from flexing and collapsing along the length of the closed cell foam, wherein the reinforcement device comprises a perforated C-shaped sheet embedded in the closed cell foam and extending circumferentially more than halfway around a central axis of the closed cell foam.

16. The method of claim 15, further comprising:

adding a flat metal disc to each end of the closed cell foam.

17. The method of claim 15, wherein the reinforcement device extends past each end of the closed cell foam.

18. The method of claim 15, wherein a first end of the closed cell foam is tapered in a manner that an inner diameter length is shorter than an outer diameter length.

19. The method of claim 15, wherein the closed cell foam is structured in a manner that an external axial force is created against an inner wall of a suction manifold.

20. The method of claim 15, wherein embedding a reinforcement device comprises embedding a plurality of reinforcement strips, each reinforcement strip embedded in and along a length of the closed cell foam.

* * * * *